United States Patent [19]

Reato

[11] 4,098,327

[45] Jul. 4, 1978

[54] RADIATOR WITH DUAL HEAT EXCHANGE FOR HEATING INSTALLATIONS

[76] Inventor: Vincenzo Reato, Via Mazzini 169/A1, Vicenza, Italy

[21] Appl. No.: 669,828

[22] Filed: Mar. 24, 1976

[30] Foreign Application Priority Data

Apr. 2, 1975 [IT] Italy ..... 85542 A/75

[51] Int. Cl.[2] ..... F28D 15/00; F28F 9/26; F24H 3/00; F24H 9/14

[52] U.S. Cl. ..... 165/76; 165/106; 165/130; 165/142; 237/71

[58] Field of Search ..... 165/106, 76, 128–130, 165/142; 237/70–74

[56] References Cited

U.S. PATENT DOCUMENTS

| | | | |
|---|---|---|---|
| 530,317 | 12/1894 | Young | 165/76 |
| 1,211,606 | 1/1917 | McDonald | 165/130 |
| 1,257,209 | 2/1918 | Fletcher | 165/142 |
| 1,470,033 | 10/1923 | Schenck | 165/130 |
| 1,569,929 | 1/1926 | Haselau | 165/130 |
| 1,686,396 | 10/1928 | Ridder | 237/73 X |
| 1,819,812 | 8/1931 | Douglass | 165/130 |
| 3,473,006 | 10/1969 | Barbier | 165/55 X |

FOREIGN PATENT DOCUMENTS

| | | | |
|---|---|---|---|
| 82,135 | 2/1957 | Denmark | 165/106 |
| 651,873 | 9/1937 | Fed. Rep. of Germany | 237/71 |
| 2,100,832 | 7/1972 | Fed. Rep. of Germany | 237/74 |
| 2,305,615 | 8/1974 | Fed. Rep. of Germany | 237/71 |
| 135,638 | 12/1919 | United Kingdom | 237/71 |
| 363,500 | 12/1931 | United Kingdom | 237/71 |
| 509,213 | 7/1939 | United Kingdom | 165/106 |

*Primary Examiner*—Charles J. Myhre
*Assistant Examiner*—Sheldon Richter
*Attorney, Agent, or Firm*—Bucknam and Archer

[57] ABSTRACT

A radiator for heating installations comprises an external container consisting of component elements, and a heat exchanger which goes through the entire assembly of elements forming the radiator acting as the tie-beam which holds the elements together. A second tie beam is positioned in the upper part of the elements to hold them together. The finned tube which constitutes the heat exchanger, is provided with an internal coaxial tube, of length slightly smaller than the external tube. The primary heating fluid returns through the internal tube so that the supply of the fluid is carried out from a single extremity of the apparatus. Since the walls of the radiator are not subjected to high pressure, the radiator may be manufactured of material of modest mechanical resistance, for instance plastic material.

4 Claims, 5 Drawing Figures

RADIATOR WITH DUAL HEAT EXCHANGE FOR HEATING INSTALLATIONS

This invention relates to radiators for use in heating installations and more specifically to radiators with a dual heat exchange.

The radiator of the present invention comprises a container for water and a heat exchanger located within the container. The primary fluid of the heating installation goes through internally the heat exchanger and this provides for heating the water placed in the radiator so that the radiator may transfer heat to the exterior through the walls of the radiator. In this manner, the radiator according to the present invention, in view of the fact that the water placed in the external container is not subjected to a high static nor dynamic pressure except the pressure resulting from the weight of water itself, is more convenient in actual operation because the walls of the radiator are not subjected to high pressure and may be constructed with material of modest mechanical resistance, for instance plastic material.

Another advantage of the radiator according to the present invention is that even in the case of a break, the only inconvenience resides in the fact that the small quantity of water placed in the radiator will escape.

The external container is made of component elements while the heat exchanger goes through the entire assembly of elements which form the radiator and the heat exchanger also acts as the tie beam which holds all the elements together. A second tie beam is located in the upper part of the elements for the purpose of holding them together.

According to a further feature of the invention, the finned tube which constitutes the heat exchanger, is provided with an internal coaxial tube of length slightly less than the length of the external tube. The internal tube serves for the return of the primary heating fluid. This assembly is particularly useful for the supply from a single extremity of the tube.

The invention will now be described in more detail by reference to the accompanying drawings of which:

Figure 1:
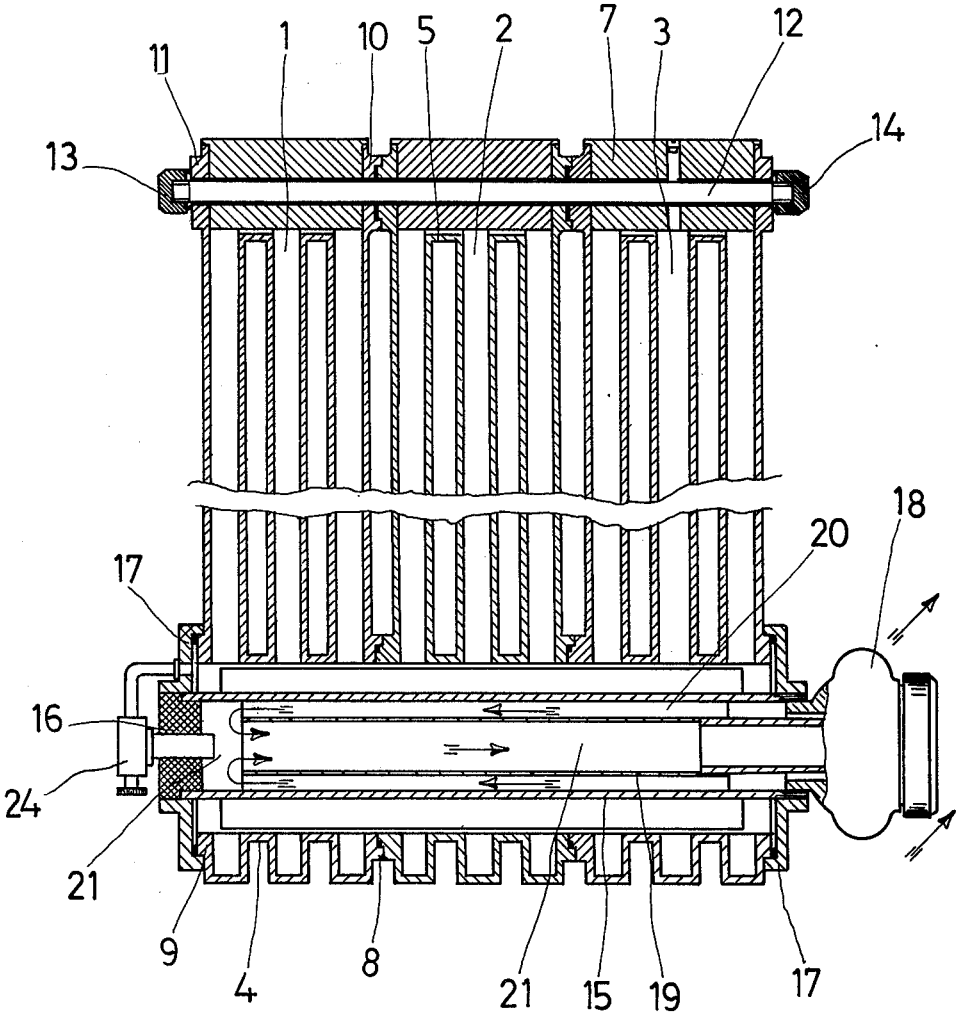
FIG. 1 represents one embodiment of the radiator according to the present invention consisting of three component elements, in cross section, according to line I—I of FIG. 2.
Figure 2:
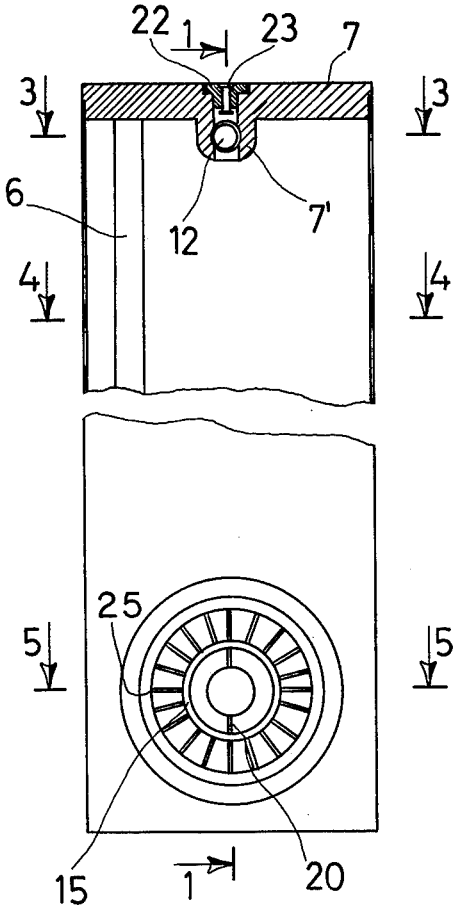
FIG. 2 represents a front view partially in section along line II—II of FIG. 3 of a radiator according to the invention.
Figure 3:
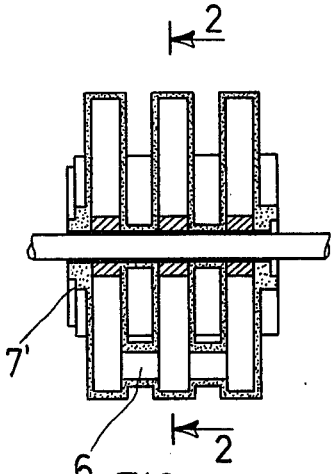
FIG. 3 represents in reduced scale a top view of FIG. 2 in section, along line III—III of one element of a radiator according to the invention.
Figure 5:
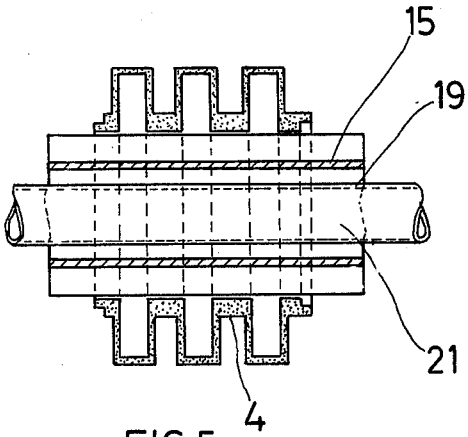
FIG. 5 represents a section along line V—V of FIG. 2.
Figure 4:
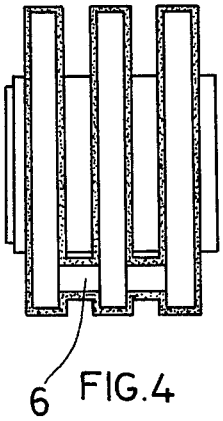
FIG. 4 represents a cross section of the same element according to line IV—IV of FIG. 2.

As shown in FIG. 1, the radiator of the invention comprises three elements 1, 2 and 3. Each element consists of a container with three hollow fins. The three fins are connected at the base by two cylindrical couplings designated by numeral 4 of greater diameter and at the top by two semi-cylindrical conduits designated by numeral 5 which have a smaller diameter. As shown in FIGS. 2, 3 and 4, numeral 6 designates two conduits which are located in the proximity of one of the sides of the element of the radiator. The two conduits 6 connect the three hollow fins which constitute the element itself corresponding to their entire height.

Numeral 7 as shown in FIG. 1 represents a shaped lid which closes the three fins which constitute one element. Numerals 8 and 9 at the base and 10 at the top represent shaped flanges which may couple and which permit to connect each element with the adjacent element by interposition of a toroidal packing which guarantees the hydraulic seal of the container.

According to another embodiment of the invention, it is possible to connect all the elements of the radiator by soldering in analogy to the lids.

It is possible to connect any number of elements in this manner for the purpose of forming a radiator, with the connection being made at the top by means of tie beam 12, which goes within the projections 7', the latter emerging from the lid 7 towards the lower part of the apparatus, with the radiator being closed at the extremities by cap nuts 13 and 14 which are provided with a packing to ensure a hydraulic seal. In the lower part, the connection is made by means of the finned tube 15 which goes through the cylindrical couplings 4 and which is closed at one end by plug 16 and which is assembled at both extremities by flanges 17 with a threaded ring on the external jacket of the finned tube. The finned tube 15 is provided with packing to obtain a hydraulic seal corresponding to the lower coupling of the element. At the other extremity there is inserted on the finned tube 15 the hydraulic connector 18 which is connected with the heating installation. Numeral 25 in FIG. 2 designates the fins.

The finned tube 15 is provided with an internal co-axial conduit 19 which defines an external space having a cylindrical crown 20. The primary heating fluid goes through the external space in the finned tube. The finned tube is also provided with a circular internal co-axial conduit 21 through which the fluid returns to the hydraulic connector 18.

This return of the fluid is made possible because the co-axial internal tube 19 is shorter than the external finned tube 15 so that a free space 21 is provided which is in front of the closure plug 16. In this manner the primary fluid which is supplied to the finned tube 15 goes from the external space having a cylindrical crown 20 into the internal co-axial cylindrical conduit 21, a feature which is conventionally required in all the connections in radiators which are supplied at one extremity with joined connections.

As shown in FIG. 2, it is advantageous that the closure lid 7 be provided in the center with plug 22 for the return of the water contained in the element of the radiator. The plug is provided with air valve 23 which prevents the element from being under pressure or from undergoing a lowering of pressure as a result of temperature variations.

According to another embodiment of the invention, a valve 24 is provided, for instance on the plug 16 which communicates with exchanger 15 for filling the radiator, utilizing the same liquid of the exchanger.

Several advantages result from the radiator according to the present invention. It is possible to obtain a heating installation with a liquid which is not under pressure in the radiator and which offers a variety of applications. There is no risk because the primary heating fluid goes through only the exchanger which is a tubular element located in the interior of the radiator while the external container is filled with water which is not under pressure. For this reason, the external element may be manufactured of any material, for instance even plastic material with no inconveniences nor difficulties which would be insurmountable with radiators operating in conventional manner.

Another advantage inherent in the radiator according to the present invention resides in the fact that the heat exchanger is arranged along the entire length of the radiator and serves as a tie beam for connection of the several elements which constitute the radiator.

What is claimed is:

1. A radiator for heating installations with dual heat exchange which comprises a container partially filled with a fluid at atmospheric pressure, said fluid constituting the secondary fluid, a heat exchanger positioned within the container, the heat exchanger being filled with the fluid of a heating installation, an inlet for the fluid, said fluid being the primary fluid, whereby heat exchange occurs to the fluid in the interior of the radiator and between the fluid in the interior of the radiator and the external atmosphere, the external container consisting of a plurality of component elements, provided with shaped flanges, spaced apart from each other, the flanges being inserted one in the other, the heat exchanger being a finned tube, said finned tube being provided with an internal coaxial tube for the return of the primary fluid towards the inlet whereby the fluid is supplied to the finned tube by means of a connector which serves as inlet and outlet, said heat exchanger being arranged along the entire length of said container and constituting at least a tie beam going through and connecting said elements, and a second tie beam connecting the elements at the end opposite to the heat exchanger.

2. The radiator according to claim 1 wherein at least one lid is provided with a plug for filling the radiator.

3. The radiator according to claim 2 wherein the plug is provided with an air valve.

4. The radiator according to claim 2 wherein the heat exchanger is provided with a valve on the plug communicating with the radiator to allow filling the radiator with the same fluid of the heat exchanger.

* * * * *